United States Patent [19]

Cicin-Sain

[11] 4,204,476

[45] May 27, 1980

[54] MOBILE DEVICE FOR RENEWAL OF RAILWAY TRACKS

[75] Inventor: Ivo Cicin-Sain, Bussigny-pres-Lausanne, Switzerland

[73] Assignee: Matisa Materiel Industriel S.A., Lausanne, Switzerland

[21] Appl. No.: 896,015

[22] Filed: Apr. 12, 1978

[30] Foreign Application Priority Data

Apr. 22, 1977 [CH] Switzerland ..... 4997/77

[51] Int. Cl.[2] ..... E01B 29/05

[52] U.S. Cl. ..... 104/2; 104/6; 105/4 R

[58] Field of Search ..... 104/1 R, 2, 4, 5, 6, 104/7 R, 7 B, 16, 17 R, 3; 105/4 R

[56] References Cited

U.S. PATENT DOCUMENTS

| | | | |
|---|---|---|---|
| 3,494,297 | 2/1970 | Plasser et al. | 104/7 B |
| 3,699,894 | 10/1972 | Plasser et al. | 104/2 |
| 4,000,699 | 1/1977 | Scheuchzer | 104/6 X |
| 4,160,418 | 7/1979 | Theurer | 104/2 |

FOREIGN PATENT DOCUMENTS

| | | | |
|---|---|---|---|
| 552160 | 6/1932 | Fed. Rep. of Germany | 104/7 R |
| 2129180 | 1/1972 | Fed. Rep. of Germany | 104/2 |
| 2614437 | 10/1977 | Fed. Rep. of Germany | 104/106 |
| 1963679 | 2/1979 | Fed. Rep. of Germany | 105/4 R |
| 2298645 | 8/1976 | France | 104/2 |

*Primary Examiner*—Randolph A. Reese
*Attorney, Agent, or Firm*—Wenderoth, Lind & Ponack

[57] ABSTRACT

There is shown a mobile machine for the renewal of railroad tracks which includes a work tool carrying chassis to replace old ties by new ones. The machine comprises two wagons, one of which is arranged to transport stock and handle the materials necessary for the track replacement and one of the two wagons rolls and advances on the new reconstituted track. The work tool carrying chassis is interposed between rolling supports of the wagons in a work zone and is suspended from a connecting member on each of the two wagons. The geometrical disposition of the supports and of the joints between the two wagons is such that the longitudinal axis of the tool carrying chassis, in the plane of the track, is automatically tangential with the longitudinal axis of the track. One of the two wagons has two spaced apart rolling supports and is provided with an overhanging extension over the work zone in the form of a bracket terminating in a joint. The second wagon is directly connected at one end to the joint and has a single rolling support spaced therefrom. The work tool carrying chassis is suspended and joined at one end of the overhanging bracket of the wagon having two rolling supports and the other end of the tool carrying chassis is suspended and joined to the wagon having the single rolling support, between the joining point and the single rolling support.

9 Claims, 5 Drawing Figures

MOBILE DEVICE FOR RENEWAL OF RAILWAY TRACKS

BACKGROUND OF THE INVENTION

The present invention relates to a mobile device for renewal of railway tracks by continuous advance along these, comprising a work tool carrying chassis adapted to ensure at least the replacement of the old ties by new ones and at least two wagons at least one of which is adapted for transport, stocking and/or the handling of the material necessary for the said track replacement.

There is already a known device of this type which has been especially described in Swiss Patent No. 511332 and which comprises a so called girder renewal joined by its two ends to two overhanging brackets of two wagons disposed one on each side of the said girder, one rolling on the old track to be renewed and the other on the reconstituted new track, and each of these two wagons have two bogies. In this device the work tool carrying chassis is suspended from the renewal girder and permits lifting of the old ties, remaking of the ballast bed and positioning of the new ties at the tangent point of the axis of the carrying chassis with the longitudinal axis of the track. A system of conveyors and of distributers installed on one of the wagons and under the renewal girder permits stocking the disposed old ties and supplying of the new ties to be positioned while a rail guiding device permits removal from the track of the old rails previously unspiked and disposes them alongside the track and places the new rails at the normal spacing on the newly laid ties.

This renewal device works satisfactorily but necessitates a large and relatively heavy structure between the two wagons in the work zone because it comprises, in addition to the tool carrying chassis, a bridge girder, two overhanging brackets and two delicate and heavily loaded joints. One of the joints must be a swivel joint and the other a Cardan joint to permit the free pivoting of the girder in all directions while preventing this from turning along its longitudinal axis with respect to one of the two wagons.

This large structure, necessary in turn for freeing of all load on the work zone and to obtain automatically the tangency of the axis of the tool carrying chassis with the axis of the track in the curves, constitutes in fact a dead load contributing to the cost of such a device and the expense of energy necessary for its use.

There is also a well known railway track renewal device in which the tool carrying chassis is suspended from a bridge girder joined to two wagons which frame it but in which the overhanging bracket of one of the two wagons is omitted. In this device the renewal girder is joined by one end at the end of the overhanging girder or the wagon on which this had been retained and by its other end, on the wagon without a bracket, perpendicular to the axis of the track, that is to say at the perpendicular of the pivotal axis of a bogie of the said wagon. This embodiment has the effect that the longitudinal axis of the renewal girder cannot be tangential to the longitudinal axis of the track in the curves but on the contrary always secant thereto and that due to this the tool carrying chassis or at least the tool for laying the new ties must necessarily be adjustably mounted if one wants to ensure the tangency in the curves of the track.

An object of the invention is to simplify the bridging structures joining the two wagons framing the work zone whilst conserving the advantage of an automatic positioning of the longitudinal axis of the tool carrying chassis on the tangent to the axis of the railway track in curves.

SUMMARY OF THE INVENTION

According to the present invention there is provided a mobile device for the renewal of railway tracks comprising a work tool carrying chassis adapted to ensure at least the replacement of old sleepers by new ones, and at least two wagons at least one of which is adapted for transport, stocking and/or the handling of material necessary for the said replacement, and one of the two wagons rolls and advances on the new reconstituted track, in which the work tool carrying chassis is interposed between the rolling supports of the wagons in a work zone, and is suspended from at least one connecting member of the said two wagons, and the geometrical disposition of the supports and of the joints of the two wagons is such that the longitudinal axis of the tool carrying chassis in the plane of the railway track is automatically tangential with the longitudinal axis of the track, one of the two wagons comprising two spaced apart rolling supports and an overhanging extension over the work zone in the form of a bracket terminating in a joint, and the other wagon is directly connected at one end to the said joint and comprises a single rolling support spaced from the said joint, and the work tool carrying chassis is suspended and joined at one end to the overhanging bracket of the wagon having two spaced apart rolling supports and at the other end to the wagon having the single rolling support, between the joining point and the said single rolling support of the wagon.

BRIEF DESCRIPTION OF THE DRAWINGS

The following is a description, by way of example, of one embodiment of the invention reference being had to the accompanying drawings in which.

DESCRIPTION OF PREFERRED EMBODIMENT

Figure 1:
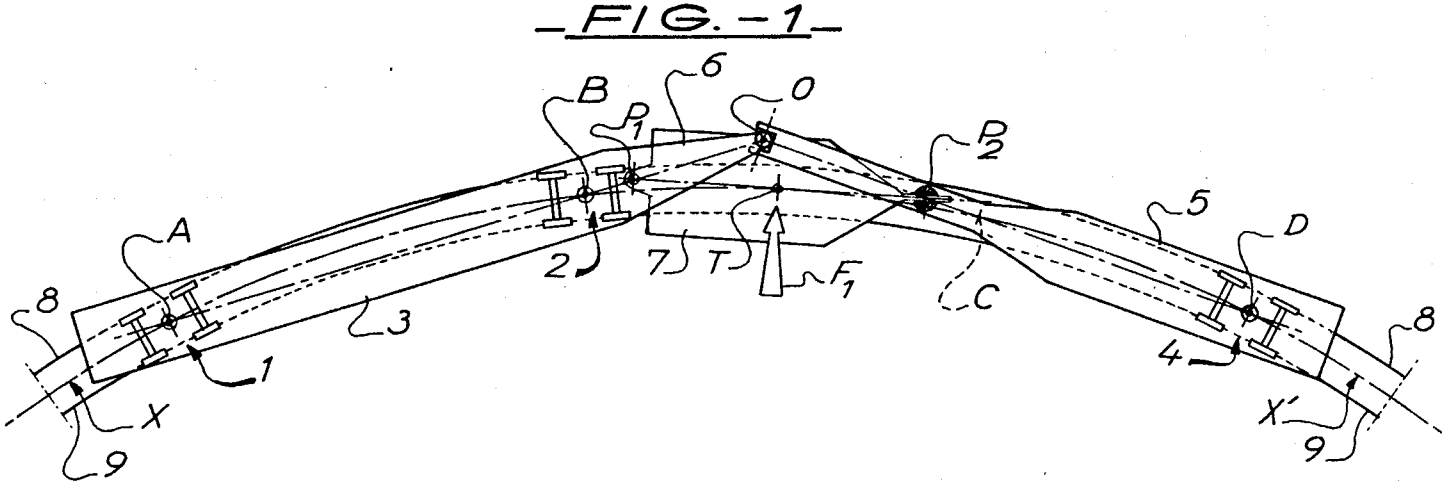
FIG. 1 is a schematic plan view of a mobile device for renewing railway tracks shown in a curve.

In FIG. 1 the two points A and B represent the pivotal axis of bogies 1 and 2 of a two bogie wagon 3, and the point D represents the pivotal axis of a single bogie 4 of a wagon 5 the chassis of which is pivotally connected to a joint O carried by an overhanging bracket 6 of the wagon 3. The points $P_1$ and $P_2$ represent the pivotal axes of the two ends of a work tool carrying chassis 7.

The points A, B and D lie on the longitudinal axes XX' of the track here represented schematically by its two rails 8 and 9, the points A, B, $P_1$ and O are aligned and form a first secant AO to the arc XX' and the points D, $P_2$ and O form a second secant DO to the said arc XX'.

The first secant AO cuts the arc XX', representing the axis of the railway track at the points A and B, representing substantially the pivotal axes of the bogies 1 and 2 of the wagon 3, and the second secant DO cuts this arc XX' at a point D representing substantially the pivotal axis of the single bogie 4 of the wagon 5 and in a second, imaginary point C.

The straight segment $P_1 P_2$, representing substantially the distance between the two pivotal axes of the tool carrying chassis 7, is tangential at a point T to the longitudinal axis XX' of the railway track.

All these points A, B, $P_1$, O, $P_2$, C, D and T are obviously here represented projected on the plane of the track; they are in reality spaced more or less from this in height.

Thus drawn, the geometry of the device schematically represented permits, within the radii of curvature usual for railway tracks and taking account of the relative proportion of the length of the said device with respect to the said radii, the automatic insurance of the tangency at the point T of the longitudinal axis $P_1 P_2$ of the tool carrying chassis 7 with the longitudinal axis XX' of the railway track in the curves. This point T is indicated here by the arrow $F_1$.

One of the two joints of the tool carrying chassis 7, point $P_2$, permits slight axial displacement of the chassis 7 so as to compensate for small variations of the distances between these two joints which are produced at the changes of the radii of curvature of the track travelled.

Figures 2, 3, 4:
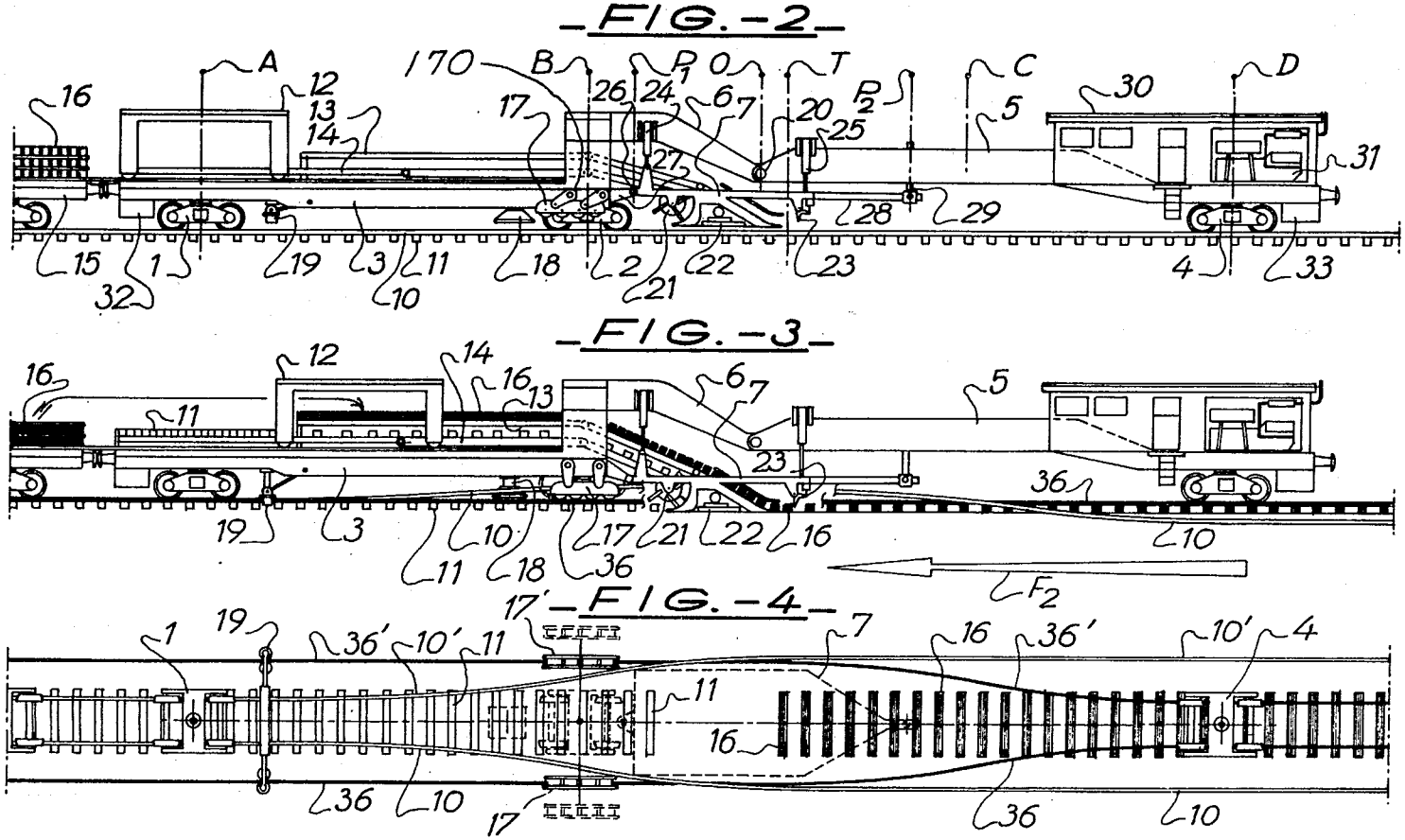
FIG. 2 is a side view of the device in a light running configuration.
FIG. 3 is a side view in a working configuration.
FIG. 4 is a partial plan view of FIG. 3.

In FIG. 2 vertical axes are designated passing through the various points shown in FIG. 1. The wagon 3 rolls on an old track comprising rails 10 and ties 11. The arrangement of the overhanging bracket 6 of the wagon 3, the wagon 5, having a single bogie 4, and the work carrying chassis 7 can be clearly seen.

Figure 4A:
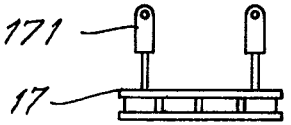
FIG. 4A is a diagrammatic detail.

The wagon 3 is equipped with a transporting gantry 12, of an accumulator-conveyor 13 for new ties and an accumulator-conveyor 14 for old ties. This wagon 3 is coupled to a stock train of new and old ties the first wagon 15 of which is partially shown with its stock of new ties 16. The wagon 3 is also equipped with two supplementary rolling supports 17, 17' mounted on supports which are swingingly extendable and retractable, vertically relative to the track about their pivots 170 under the action of gravity or any suitable means and disposed on each side of the bogie 2 situated near the overhanging bracket 6. The supports 17,17' may also if desired be movable transversely relative to the track by any suitable means diagrammatically shown as hydraulic cylinders 171 in FIG 4A. It also has a vertically retractable bearing shoe 18 and a rail positioning device 19 which is vertically and transversely extendable and retractable. These members 17, 18 and 19, as seen in FIG. 2, are retracted for light running. The flange 18 is adapted to lift up the bogie 2 during setting down of the supplementary supports 17, as will be shown further on.

A swivel joint 20, on the vertical axis passing through the point 0, connects the wagon 5 to the wagon 3. This joint ensures the free pivoting of these two wagons in all directions as well as their axial rotation, at least within the maximum limits of the curves and bends of the railway tracks.

The work tool carrying chassis 7, here shown in the raised position for light running, comprises, from left to right on the drawing, a tie removing tool 21, a ballast bed remaking tool 22 and a tie positioning tool 23. The removing tool 21 and the positioning tool 23 are respectively connected to the accumulator-conveyors 14 and 13 of the wagon 3 by two articulated conveyors.

The chassis 7 is vertically adjustable by a group of vertically hanging jacks 24 and 25, and is pivotally connected, perpendicular of the axis passing through the point $P_1$, to a vertical pivot 26 carried by a rocking lever 27 connected to the bottom of the bracket 6, at the joint of this with the chassis of the wagon 3. At its other end, constituted by a shaft 28, the chassis 7 is connected to a second pivot 29 comprising a rotatable end mounted bearing through which the said shaft 28 slides axially. Moreover, this pivot 29 is guided in a vertical slide connected to the chassis of the wagon 5 so as to permit the free height adjustment of the tool carrying chassis 7 by the jacks 24 and 25.

The wagon 5 comprises a control cabin 30 and a group energy generator 31 adapted to supply all the services of the renewal device. A locomotive vehicle, not shown, is coupled at the end of the tie stock wagon train. The small material, tie screws, sole plates, fish plates, etc. . . is stocked in containers 32 and 33, respectively, disposed at the end of the wagon 3 and of the wagon 5, so as to counter-balance the overhanging structures of the system as much as possible.

In the working configuration shown in FIGS. 3 and 4, the new rails 36–36' are shown in heavy lines for replacing the old rails 10–10'. These new rails have previously been laid on each side along the railway track to be renewed and outside the old ties 11 to be replaced which are shown lightly drawn as opposed to the new ties 16 which are shown in dark lines.

When commencing the renewal operation the flange 18 is lowered so as to lift the bogie 2 of the wagon 3, for example by means of a hydraulic jack operating between the flange 18 and the chassis of the wagon 3, to permit the two supplementary rolling supports 17–17' to be lowered to engage and ride on the new rails 36–36'. The rail positioner 19 is put into service at the same time. Then, after the cutting of the old track and operating the work tools of carrying chassis 7 in known manner, the device advances in accordance with the arrow $F_2$, from right to left. The wagon 3 rolls supported partly by its bogie 1 on the old track to be renewed, partly by its supplementary rolling supports 17–17' on the new rails 36–36' previously adjusted with respect to their spacing by the positioning device 19, and the wagon 5 rolls on the new reconstituted track.

Between these two wagons, that is to say underneath the carrying structure which they form, the old sleepers 11 are lifted by the removing tool 21 and removed therefrom by the conveyor-accumulator complex 14 and the gantry 12 onto the stocking wagons, the ballast bed is levelled and adjusted by the remaking tool 22 and the new ties 16 are brought by the gantry 12 and the conveyor-accumulator complex 13 to the laying tool 23, so that the old rails 10–10' are removed and replaced by the new 36–36' in known manner and already described, in particular in the abovementioned Swiss Pat. No. 511332.

As will be seen the device provides a simplification of and lightening of the carrying bridge structure permitting the automatic positioning of the longitudinal axis of the tool carrying structure 7 on the tangent to the longitudinal axis of the track. In fact, with respect to the known device, the same effect is achieved without the necessity of having a bridge structure comprising an articulated girder between the two overhanging brackets of the two wagons having two bogies framing the girder, but simply the two wagons with one of these two wagons needing only one bogie, and only one girder and one overhanging bracket rather than two in each instance.

Moreover, the preferred addition of the two supplementary rolling supports 17–17' suitable for rolling on the new rails 36–36' previously laid outside the old track permits the commencement of removal of the old rails 10–10' below the wagon 3, which permits the shortening of the span of the carrying bridge structure for a same bending constraint of the rails.

Further, the supplementary rolling supports 17–17' could be arranged to roll directly on the ballast, outside the track (see exaggerated position dotted lines FIG. 4) and would be for example to this effect constituted by tracks or low pressure tired wheels.

The pivot 29 of the work tool carrying chassis 7 could be articulated by its end opposite to the rotatable bearing to a horizontal axle transverse to the track, and the shaft 28 of the carrying chassis could comprise an articulated fork having a horizontal axle transverse to the track integral with the said rotatable bearing.

What we claim is:

1. A mobile device for the renewal of railway tracks comprising a work tool carrying chassis adapted to ensure at least the replacement of old ties by new ones, and at least two wagons, joined together and mounted on rolling supports, at least one of which wagons is adapted for transport and the handling of material necessary for the said replacement, and one of the two wagons rolls and advances on new reconstituted track, in which the work tool carrying chassis is interposed between the rolling supports of the wagons in the work zone, and is suspended from at least one connecting member of the said two wagons, and the geometrical disposition of the supports and of the joint of the two wagons is such that the longitudinal axis of the tool carrying chassis in the plane of the railway track is automatically tangential with the longitudinal axis of the track, one of the two wagons comprising two spaced apart rolling supports and an overhanging extension over the work zone in the form of a bracket terminating in the joint, and the other wagon is directly connected at one end to the said joint and comprises a single rolling support spaced from the said joint, and the work tool carrying chassis is suspended and joined at one end to the overhanging bracket of the wagon having two spaced apart rolling supports and at the other end to the wagon having the single rolling support, between the joint and the said single rolling support of the wagon.

2. A device in accordance with claim 1, in which the junction of the two wagons is an articulation having swivel actions ensuring the free articulation of the wagons in all directions as well as their axial rotation, at least within the medium limits of the curves and bends of the railway tracks.

3. A device in accordance with claim 1, in which two supplementary rolling supports are disposed on each side of the said rolling support which is situated on the side of the overhanging bracket of the wagon having two rolling supports, and means is provided for extending and retracting said supplementary rolling supports transversely to the track.

4. A device in accordance with claim 11, in which the two supplementary rolling supports are adapted to run on the ballast outside the ties of the track and on each side of the track.

5. A device in accordance with claim 3, in which the two supplementary rolling supports are adapted to run on rails disposed on the ballast outside the ties of the track and on each side of the track.

6. A device in accordance with claim 5, in which a rail positioning device is provided adapted to set the rails disposed on the ballast at a spacing corresponding to that of the two supplementary rolling supports in the extended position and this positioning device is disposed in front of the said two supplementary rolling supports in the direction of advance of work.

7. A device in accordance with claim 3, in which a shoe is provided to permit raising of the rolling support.

8. A device in accordance with claim 1, in which the work tool carrying chassis is connected at its two ends to two vertical pivots one connected to the overhanging bracket of the two rolling supports wagon and the other to the wagon having one rolling support and one of the two ends of this carrying chassis is constituted by a shaft sliding axially in a rotatable bearing mounted at the end of the pivot to which it is connected.

9. A device in accordance with claim 8 in which at least one of the two vertical pivots is vertically adjustably mounted.

* * * * *